US005567565A

United States Patent [19]

Larson et al.

[11] Patent Number: 5,567,565

[45] Date of Patent: Oct. 22, 1996

[54] METHOD FOR TRANSFERRING A TONER IMAGE

[75] Inventors: James R. Larson, Fairport; Santokh S. Badesha, Pittsford; Anthony M. Wallace; Donald S. Sypula, both of Penfield, all of N.Y.

[73] Assignee: Xerox Corporation, Stamford, Conn.

[21] Appl. No.: 275,481

[22] Filed: Jul. 15, 1994

[51] Int. Cl.[6] ..... G03G 13/16

[52] U.S. Cl. ..... 430/126; 430/47; 355/273; 428/491

[58] Field of Search ..... 430/126, 47; 355/273; 428/491

[56] References Cited

U.S. PATENT DOCUMENTS

| | | | |
|---|---|---|---|
| 3,893,761 | 7/1975 | Buchan et al. | 355/3 R |
| 4,430,412 | 2/1984 | Miwa et al. | 430/126 |
| 4,684,238 | 8/1987 | Till et al. | 355/10 |
| 4,708,460 | 11/1987 | Langdon | 355/10 |
| 4,796,048 | 1/1989 | Bean | 355/37 R |
| 5,035,972 | 7/1991 | El-Sayed et al. | 430/114 |
| 5,099,286 | 3/1992 | Nishise et al. | 355/272 |
| 5,119,140 | 6/1992 | Berkes et al. | 355/273 |
| 5,208,638 | 5/1993 | Bujese et al. | 355/274 |
| 5,233,396 | 8/1993 | Simms et al. | 355/275 |
| 5,459,008 | 10/1995 | Chambers et al. | 430/126 |

*Primary Examiner*—John Goodrow

*Attorney, Agent, or Firm*—Oliff & Berridge; Eugene O. Palazzo

[57] ABSTRACT

An intermediate transfer member achieves substantially 100% toner transfer by containing a fluorocarbon elastomer containing less than 60 mole % vulnerable sites in the fluorocarbon chain. A high resolution image can be produced in an image developing system containing such a fluorocarbon elastomer. The fluorocarbon elastomer reduces the charge exchange between toner particles and the intermediate transfer member, and also reduces charge exchange between charge directors in liquid developers and the intermediate transfer member.

23 Claims, 1 Drawing Sheet

METHOD FOR TRANSFERRING A TONER IMAGE

FIELD OF THE INVENTION

This invention relates to an apparatus and method for developing an image in which a toner image is transferred from an electrostatographic imaging member to an image receiving substrate via an intermediate transfer member.

BACKGROUND

A typical electrostatographic printing machine (such as a photocopier, laser printer, facsimile machine or the like) employs an imaging member that is exposed to an image to be printed. Exposure of the imaging member to the image to be printed records an electrostatic latent image on the imaging member corresponding to the informational areas contained within the image to be printed. Generally, the electrostatic latent image is developed by bringing a toner or developer mixture into contact therewith.

One type of developer used in such printing machines is a liquid developer comprising a liquid carrier having toner particles dispersed therein. Generally, a suitable colorant also is present in the toner particles such as a dye or pigment. The liquid developer material is advanced into contact with the electrostatic latent image and the colored toner particles are deposited thereon in image configuration.

The developed toner image recorded on the imaging member may be transferred to an image receiving substrate such as paper via an intermediate transfer member. The toner image particles may be electrostatically transferred to the intermediate transport member by means of an electrical potential between the imaging member and the intermediate transfer member. After the toner image has been transferred to the intermediate transfer member, it is then transferred in image configuration to the image receiving substrate, such as by contacting the substrate with the image on the intermediate transfer member under heat and/or pressure.

In electrostatographic printing machines in which the toner image is electrostatically transferred by a potential between the imaging member and the intermediate transfer member, the transfer of the toner particles to the intermediate transfer member and the retention thereof should be as complete as possible so that the image ultimately transferred to the image receiving substrate will have a high resolution. Substantially 100% toner transfer occurs when most or all of the toner particles comprising the image are transferred and little residual toner remains on the surface from which the image was transferred. Substantially 100% toner transfer is particularly important when the imaging process involves generating full color images since undesirable shifting or color deterioration in the final colors can occur when the primary color images are not accurately and efficiently transferred to and from the intermediate transfer member.

Intermediate transfer members enable high throughput at modest process speeds. In color systems, the intermediate transfer member also improves registration of the final color toner image. In such color systems, component colors such as cyan, yellow, magenta, and black are synchronously developed onto one or more imaging members and transferred in registration onto an intermediate transfer member at one or more transfer stations. Intermediate transfer members also increase the range of final substrates that can be used, including papers, etc. A disadvantage of using an intermediate transfer member is that a plurality of transfer steps is required. In the process of electrostatically transferring toner images from the imaging member to an intermediate, charge exchange can occur between toner particles and the transfer member leading to less than complete toner transfer.

In a typical electrostatographic printing machine, toner particles, which can have either a negative or a positive charge, are positioned on the imaging member after development. A charged biased transfer roller or a corona supplies a charge to the backside of an intermediate transfer member to attract the oppositely charged toner particles. The charge on the backside of the intermediate transfer member, attracts the toner particles to the front side of the intermediate transfer member. Theoretically, toner transfer should be 100%. However, toner transfer is in practice frequently less than 100% due to the phenomenon of charge exchange between toner particles and the intermediate transfer member. In charge exchange, the toner particle charge is reduced so that it is not attracted to the transfer member or reversed so that it is repelled from the transfer member having a like charge. The more severe the charge exchange is, the less complete toner transfer to the intermediate is. Without wishing to be bound by any theory, charge exchange is believed to be associated with electrochemical phenomena occurring at the interface between the toner layer and the intermediate transfer member.

Charge exchange is a problem in that low charge, neutral, or 'wrong sign' toner particles lead to incomplete toner transfer. The result is low resolution images on the image receiving substrate, including images suffering from image deterioration. If the images are color, the image additionally suffers from color shifting and color deterioration.

The formation of proper images also depends on the differences of the charge between the toner in the liquid developer and the electrostatic image to be developed. Thus, it is usually necessary to add a charge director compound to the liquid developer. Liquid developers containing charge directors provide images of good quality and resolution due to the improved charging of the toner. However, the use of charge directors also can exacerbate the problem of charge exchange between the toner and the intermediate transfer member.

U.S. Pat. No. 4,796,048 (Bean) discloses an apparatus which transfers a plurality of liquid images from a photoconductive member to a copy sheet. The apparatus may include an intermediate transport belt to transfer a toner image to a copy sheet with the use of a biased transfer roller. The intermediate transport belt has a smooth surface, is non-absorbent and has a low surface energy.

U.S. Pat. No. 4,708,460 (Langdon) discloses an intermediate transport belt that is preferably made from a somewhat electrically conductive silicone material having an electrical conductivity of about $10^9$ ohm-centimeters so that the belt is semiconductive.

U.S. Pat. No. 4,430,412 (Miwa et al.) discloses an intermediate transfer member, which may be a belt-type member that is pressed onto an outer periphery of a toner image retainer with a pressure roller. The intermediate member is formed with a laminate of a transfer layer comprising a heat resistant elastic body such as silicone rubber or fluororubber, and a heat resistant base material such as stainless steel. Silicone rubber is the only material shown in the examples as the transfer layer. No fluorocarbon elastomer having a reduced number of vulnerable sites as the transfer member surface is suggested.

U.S. Pat. No. 3,893,761 (Buchan et al.) discloses a xerographic heat and pressure transfer and fusing apparatus having an intermediate transfer member which has a smooth surface, a surface-free energy below 40 dynes per centimeter and a hardness from 3 to 70 durometer Shore A. The transfer member, preferably in the form of a belt, can be formed, for example, from a polyamide film substrate coated with 0.1–10 millimeters of silicone rubber or fluoroelastomer. Silicone rubber is the only material shown in the examples as the transfer layer. No fluorocarbon elastomer having a reduced number of vulnerable sites as the transfer member surface is suggested.

U.S. Pat. Nos. 4,684,238 (Till et al.) and 4,690,539 (Radulski et al.) disclose single layer intermediate transfer belts composed of polyethylene terephthalate or other suitable propylene material.

U.S. Pat. No. 5,119,140 (Berkes et al.) discloses a single layer intermediate transfer belt preferably fabricated from clear Tedlar® (a polyvinyl fluoride available from E. I. du Pont de Nemours & Co.), carbon loaded Tedlar® or pigmented Tedlar®. Tedlar® is a thermoplastic polymer, not an elastomer.

U.S. Pat. No. 5,099,286 (Nishise et al.) discloses an intermediate transfer belt comprising electrically conductive urethane rubber reportedly having a volume resistivity of $10^3$ to $10^4$ ohm-centimeter and a dielectric layer of polytetrafluoroethylene reportedly having a volume resistivity equal to or greater than $10^{14}$ ohm-centimeter.

U.S. Pat. No. 5,208,638 (Bujese et al.) relates to an intermediate transfer member surface comprising a fluorosilicone polymer with a conductive material dispersed therein upon a metal layer, which in turn is upon a dielectric layer. The use of fluorosilicone elastomers is disclosed, but there is no disclosure or suggestion of the improved transfer efficiency achievable by the use of fluorocarbon elastomer having a reduced number of vulnerable sites.

U.S. Pat. No. 5,233,396 (Simms et al.) discloses an intermediate transfer member which is semiconductive and comprises a thermally and electrically conductive substrate coated with a semiconductive, low surface energy elastomeric outer layer that is preferably Viton® B50 (a fluorocarbon elastomer).

U.S. Pat. No. 5,035,972 (El-Sayed et al.) discloses an AB diblock copolymer as a charge director for negative electrostatic liquid developers.

A need remains for intermediate transfer members with sufficient mechanical strength and chemical and electrical properties that enable generation of high resolution images because of near complete transfer of all toner particles to and from the surface of the intermediate transfer member. Also, there is a need for a process of developing an image using an electrostatographic printing machine containing an intermediate transfer member and using a liquid color developer in which the resultant image has high color fidelity and resolution due to near complete transfer of the toner particles from the intermediate surface.

SUMMARY OF THE INVENTION

The invention relates to an intermediate transfer member having a reduced number of vulnerable sites so as to eliminate or minimize the amount of charge exchange between the intermediate transfer member and the toner of a liquid developer. The image produced has high resolution due to the substantially 100% transfer of toner particles to and from an intermediate transfer member. Furthermore, when such a transfer member is used in conjunction with a liquid developer containing a charge director, charge exchange between the member and the charge director is minimized or eliminated so that substantially 100% toner transfer can occur to produce a high resolution image. Preferably, the intermediate transfer member comprises a fluorocarbon elastomer that contains a controlled number of vulnerable sites.

DETAILED DESCRIPTION OF PREFERRED EMBODIMENTS

Figure 1:
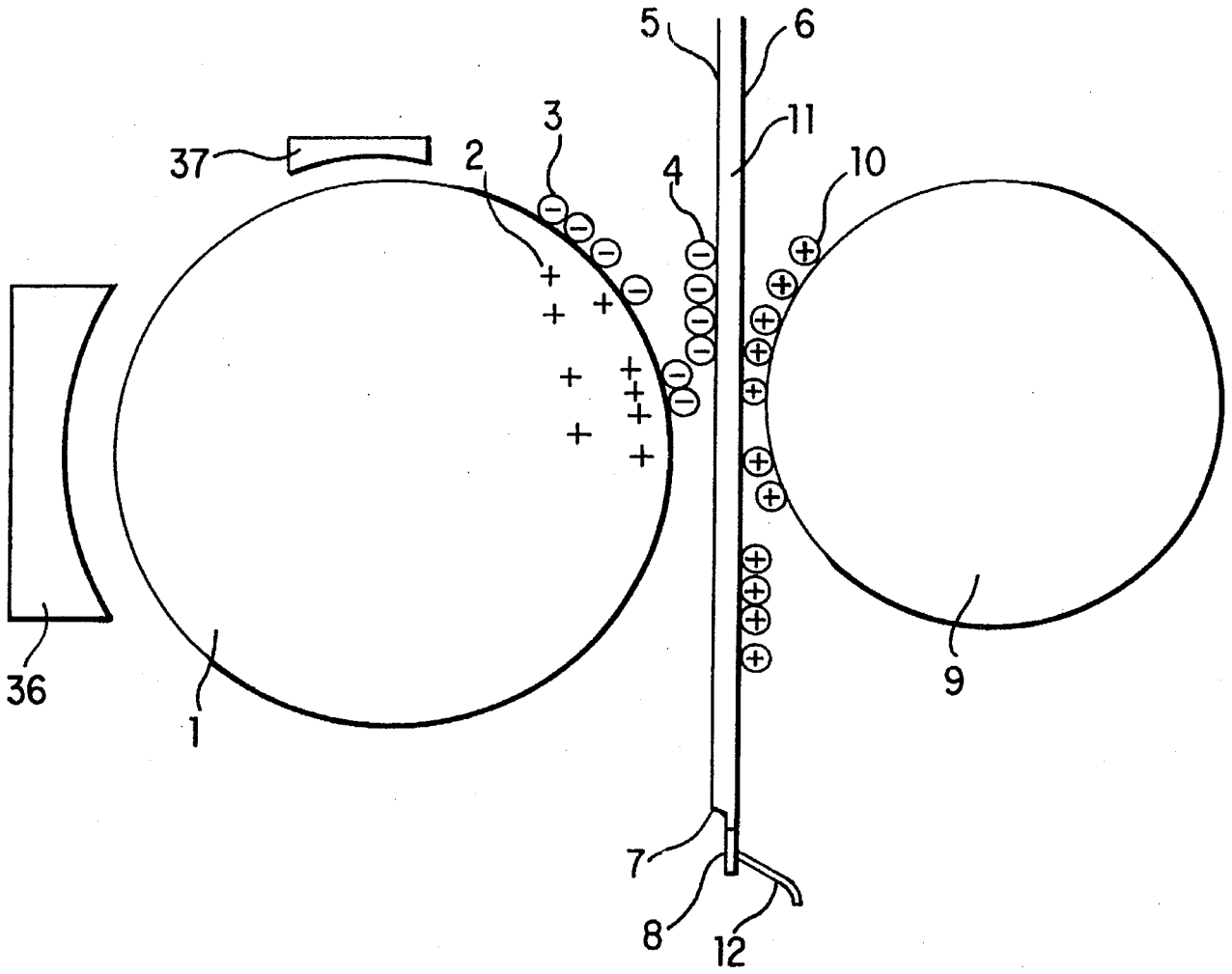
FIG. 1 is a schematic view of an image development system containing an intermediate transfer member.

As used herein, the amount of "vulnerable sites" refers to the amount of $CH_2$-$CF_2$ groups in the chain of a fluorocarbon elastomer.

In the invention, an intermediate transfer member is preferably comprised of a fluorocarbon elastomer material that has good dimensional stability and is compliant to image receiving substrates. The fluorocarbon elastomer should have fewer than 60 mole % vulnerable sites, preferably less than 50 mole % vulnerable sites, and most preferably less than 40 mole % vulnerable sites in the fluorocarbon chain. Most preferably, the intermediate transfer member comprises a material that is a copolymer of vinylidene fluoride, hexafluoropropylene and tetrafluoroethylene terpolymer. Such a material is commercially available under the tradename Viton GF from E. I. du Pont de Nemours & Co.

In FIG. 1, the intermediate transfer member 11 is positioned between an imaging member 1 and a transfer roller 9. The imaging member 1 is exemplified by a photoreceptor drum. However, other appropriate imaging members may include other electrostatographic imaging receptors, such as ionographic belts and drums, electrophotographic belts, etc.

In the multi-imaging system of FIG. 1, each image being transferred is formed on the imaging drum by image forming station 36. Each of these images is then developed at developing station 37 and transferred to intermediate transfer member 11. Each of the images may be formed on the photoreceptor drum 1 and developed sequentially and then transferred to the intermediate transfer member 11, or, in an alternative method, each image may be formed on the photoreceptor drum 1, developed, and transferred in registration to the intermediate transfer member 11. In a preferred embodiment of the invention, the multi-image system is a color copying system. In this color copying system, each color of an image being copied is formed on the photoreceptor drum. Cyan, yellow, magenta and black are four toner colors commonly used in such color copying systems. Each of these color images is developed and transferred to the intermediate transfer member 11. As above, each of the colored images may be formed on the drum 1 and developed sequentially and then transferred to the intermediate transfer member 11, or, in the alternative method, each color of an image may be formed on the photoreceptor drum 1, developed, and transferred in registration to the intermediate transfer member 11.

After latent image forming station 36 has formed the latent image on the photoreceptor drum 1 and the latent image of the photoreceptor has been developed at developing station 37, the charged toner particles 3 from the developing station 37 are attracted and held by the photoreceptor drum 1 because the photoreceptor drum 1 possesses a charge 2 opposite to that of the toner particles 3. In FIG.

1, the toner particles are shown as negatively charged and the photoreceptor drum 1 is shown as positively charged. These charges can be reversed, depending on the nature of the toner and the machinery being used. In the preferred embodiment, the toner is present in a liquid developer.

A biased transfer roller 9 positioned opposite the photoreceptor drum 1 has a higher voltage than the surface of the photoreceptor drum 1. As shown in FIG. 1, biased transfer roller 9 charges the backside 6 of intermediate transfer member 11 with a positive charge. In an alternative embodiment of the invention, a corona or any other charging mechanism may be used to charge the backside 6 of the intermediate transfer member 11.

The negatively charged toner particles 3 are attracted to the front side 5 of the intermediate transfer member 11 by the positive charge 10 on the backside 6 of the intermediate transfer member 11.

The intermediate transfer member may be in the form of a sheet or belt, as it appears in FIG. 1, or in the form of a roller or other suitable shape. Intermediate transfer members need to be comprised of materials that have good dimensional stability, are resistant to attack by materials of the toner or developer, and are conformable to image receiving substrates. The fluorocarbon elastomers of the present invention possess these properties. Possessing conformability means that the material is able to contact an image receiving substrate with substantially complete smoothness, that is, that the material conforms to match the topography or contour of the surface of the substrate. The image produced on the substrate is complete and full in color as a result. A material lacking conformability produces images having varying shades (i.e., areas lighter in color than other areas) and even incomplete in areas where the toner was unable to contact the substrate.

The intermediate transfer member 11 may comprise the fluorocarbon elastomer alone, or the fluorocarbon elastomer may be coated upon a substrate such as thermally and electrically semiconductive substrate 8. Examples of suitable substrate 8 materials include but are not limited to polyimides, stainless steel and numerous metallic alloys. After the toner latent image has been transferred from the photoreceptor drum to the intermediate transfer member, the intermediate transfer member may be contacted under heat and pressure to an image receiving substrate such as paper. The toner image on the intermediate transfer member is then transferred and fixed, in image configuration, to the substrate.

Chemical Corporation) and Norpar® (high purity normal paraffinic liquids commercially available from Exxon Chemical Corporation). Toner particles are present in the liquid developer, and can include well known pigments and dyes as a colorant material. Resinous binders are also known to be used in liquid developers, such as for example styrene/butadiene copolymers. Conventional additives such as plasticizers, surfactants and metal stearates may also be included in liquid developer compositions.

It is important in the transfer process that toner particles be nearly completely transferred both to and from the intermediate transfer member. As the number of toner particles not transferred increases, the resolution of the end image upon the image receiving substrate decreases. One of the single most significant factors contributing to the non-transfer of toner particles is charge exchange between the toner particles and the intermediate transfer member. The charge exchange results in wrong sign toner that does not transfer properly.

It is known in the art to include in liquid developers a charge director compound to improve the resultant image quality. The use of charge directors allows for some control over the toner particles' charge. Charge directors known and used in the art include Basic Barium Petronate® (an oil-soluble petroleum sulfonate available from Witco Chemical Corp.), as well as an AB diblock copolymer charge director as disclosed in U.S. Pat. No. 5,035,972, which is hereby incorporated by reference in its entirety.

The use of charge directors in liquid developers has allowed control over the charge of the toner particles, but also has had the effect of exacerbating the problem of charge exchange between the toner and the intermediate transfer member. This has been especially true with intermediate transfer materials such as Viton® B50 (a fluorocarbon elastomer copolymer of vinylidene fluoride and hexafluoropropylene available from E. I. du Pont de Nemours & Co.).

Using a fluorocarbon elastomer of the invention as the intermediate transfer member material enables high yield transfer of toner particles from the photoreceptor to the intermediate transfer member. Further, such fluorocarbon elastomer also greatly reduces the charge exchange between the intermediate transfer member and both the toner and the charge director optionally in the developer.

In Table 1, the structural compositions of fluorocarbon elastomer compositions are compared as to the mole percentage of vulnerable sites present.

TABLE 1

| VITON TYPE | COMPOSITION | MOLE % $(CH_2-CF_2)-$ | % F |
|---|---|---|---|
| E-45 | $\backslash\sim-(CH_2-CF_2)_x-(CF(CF_3)-CF_2)_y-\backslash\sim$ | 77 | 65 |
| B-50 | $\backslash\sim-(CH_2-CF_2)_x-(CF(CF_3)-CF_2)_y-(CF_2-CF_2)_z-\backslash\sim$ | 61 | 67 |
| GF | $\backslash\sim-(CH_2-CF_2)_x-(CF(CF_3)-CF_2)_y-(CF_2-CF_2)_z(XBr)-\backslash\sim$ | 35 | 69 |
| TEFLON | $-(CF_2-CF_2)_n$ | 0 | 76 |

In a preferred embodiment of the present invention, toner particles are supplied in a liquid developer. Liquid developers comprise liquid carriers such as, for example, Isopar® (aliphatic hydrocarbons commercially available from Exxon In the Viton GF composition, "X" is proprietary information to E. I. du Pont de Nemours & Co., and represents crosslink sites. Also for Viton GF, x represents 35 mole %, y represents 34 mole %, z represents 29 mole % and XBr is present in about 2 mole %.

For Viton E-45, x is 77 mole % and y is 23 mole %. For Viton B-50, x represents 61 mole %, y is 17 mole % and z is 22 mole %.

Polytetrafluoroethylene, for example Teflon® is unacceptable as an intermediate transfer material because it lacks conformability to an image receiving substrate. Lack of conformability results in poor transfer of the image from the transfer member to an image receiving substrate because the material of the transfer member does not conform satisfactorily to the image receiving substrate at the transfer point.

The use of a fluorocarbon elastomer having fewer than 60 mole % vulnerable sites, preferably less than 50 mole % vulnerable sites, and most preferably less than 40 mole % vulnerable sites in the fluorocarbon chain results in substantially 100% toner transfer, fix to the paper and very good image resolution.

The transfer efficiency of an intermediate transfer member of fluorocarbon elastomer having a reduced number of vulnerable sites is demonstrated in the following examples.

In the examples, the percentage deposition of charged toner particles onto a fluorocarbon elastomer is measured by filling a cell with liquid developer containing 0.2% negatively charged toner particles and applying a field to deposit the toner particles on the elastomer. Toner that does not deposit is recharged and electrostatically deposited onto paper. The relative amount of toner on the paper is determined by reflectance density. The percentage deposition on the fluorocarbon elastomer is determined with regard to the relative amount of toner deposited on the paper (i.e., the less toner deposited on the paper, the more deposited on the elastomer).

In each of the examples, the fluorocarbon elastomer has a thickness of 3 mil. The liquid developer used comprises Norpar 15 (solvent), Nucrel 599 (a polyethylene methacrylic acid available from E. I. du Pont de Nemours), Fanal Pink (22%), and aluminum stearate (2%).

EXAMPLE 1

An intermediate transfer member is fabricated from a blend of Viton GF (100 parts ), Thermax carbon black (15 parts), calcium hydroxide (1.5 parts), and magnesium oxide (2.0 parts). This blend is prepared by mixing in a rubber mill. To 100 grams of this blend, 1000 ml of methyl ethyl ketone are added and the contents are ball milled for 48 hours. The resulting dispersion is then spray coated on to a steel substrate to a dry thickness of 2.0 mils. The coating is cured in an oven where the specimen is heated for 2 hours at 77° C., 2 hours at 105° C., 2 hours at 149° C., 4 hours at 177° C., and 16 hours at 230° C. A selected voltage is applied to the intermediate transfer member for a selected time, and the intermediate transfer member is then exposed to an oppositely charged liquid developer containing a charge director. In Example 1A, the charge director is Basic Barium Petronate (BBP), and in Example 1B, the charge director is an AB diblock copolymer as disclosed in U.S. Pat. No. 5,035,972.

The percentage of deposition of the toner particles onto the intermediate transfer member is shown in Table 2. The higher the percentage deposition, the more efficient and complete is the toner transfer.

COMPARATIVE EXAMPLE 1

The procedure of Example 1 is repeated, except that the intermediate transfer member material is Viton B50, a fluorocarbon elastomer containing about 61 mole % vulnerable sites. Again, in Comparative Example 1A, a BBP charge director is used in a conventional liquid developer, and in Comparative Example 1B, an AB diblock copolymer is used as a charge director in a liquid developer.

The percentage deposition of the toner particles onto the intermediate transfer member of the comparative example is shown in Table 2.

TABLE 2

| | | % Deposition onto Viton Charge Director/Viton | | | |
|---|---|---|---|---|---|
| Time (Sec) | Field (KV/mm) | Comparative 1 A | 1 A | Comparative 1 B | 1 B |
| 2 | 1 | 65% | 95% | 98% | 100% |
| 2 | 6 | 0% | 75% | 85% | 100% |
| 10 | 1 | 0% | 80% | 90% | 100% |
| 10 | 6 | 0% | 85% | 100% | 95% |

Table 2 indicates that a fluorocarbon elastomer having few vulnerable sites is greatly improved in toner transfer efficiency over conventional fluorocarbon elastomers utilized as intermediate transfer member materials. The discovery of a charge exchange resistant intermediate is significant. It increases the flexibility on charge director selection for use in a liquid developer and increases the resolution of an image produced regardless of the type of liquid developer used.

While this invention has been described in conjunction with specific embodiments thereof, alternatives, modifications, and variations will be apparent to those skilled in the art. Accordingly, it is intended to embrace all such alternatives, modifications and variations as fall within the spirit and scope of the appended claims.

What is claimed is:

1. An intermediate transfer member for transferring a toner image from an electrostatographic imaging member to an image receiving substrate, said intermediate transfer member being in the form of a roller, belt or sheet configured for operating in an electrostatographic printing system having an electrostatographic imaging member, and said intermediate transfer member comprising a fluorocarbon elastomer containing less than 60 mole % vulnerable sites in the fluorocarbon chain and said fluorocarbon elastomer being conformable.

2. An intermediate transfer member according to claim 1, wherein said fluorocarbon elastomer contains less than 50 mole % vulnerable sites in the fluorocarbon chain.

3. An intermediate transfer member according to claim 1, wherein said fluorocarbon elastomer contains less than 40 mole % vulnerable sites in the fluorocarbon chain.

4. The intermediate transfer member of claim 1, wherein said fluorocarbon elastomer comprises a terpolymer of vinylidene fluoride, hexafluoropropylene and tetrafluoroethylene.

5. The intermediate transfer member of claim 4, wherein said fluorocarbon elastomer has a fluorocarbon chain formula of:

$$-(CH_2-CF_2)_x-(\overset{\overset{\displaystyle CF_3}{|}}{C}F-CF_2)_y-(CF_2-CF_2)_z(XBr)-$$

wherein x represents 35 mole %, y represents 34 mole %, z represents 29 mole %, X represents crosslink sites, and the percent of XBr is about 2 mole %.

6. A method for producing an image in an electrostatographic imaging system comprising exposing an imaging member to an image to produce an electrostatic latent image, developing said electrostatic latent image by contacting said latent image with a developer to produce a developed image, electrostatically transferring said developed image from said imaging member to an intermediate transfer member, and transferring said developed image from the intermediate transfer member to an image receiving substrate, wherein said intermediate transfer member comprises a fluorocarbon elastomer containing less than 60 mole % vulnerable sites in the fluorocarbon chain which reduces charge exchange between said developer and said intermediate transfer member, said method resulting in substantially 100% toner transfer.

7. The method according to claim 6, wherein said method is a four-color copying method.

8. The method according to claim 6, wherein said intermediate transfer member comprises a fluorocarbon elastomer having less than 50 mole % vulnerable sites in the fluorocarbon chain.

9. The method according to claim 6, wherein said intermediate transfer member comprises a fluorocarbon elastomer having less than 40 mole % vulnerable sites in the fluorocarbon chain.

10. The method according to claim 6, wherein said fluorocarbon elastomer comprises a terpolymer of vinylidene fluoride, hexafluoropropylene and tetrafluoroethylene.

11. The method according to claim 10, wherein said fluorocarbon elastomer has a fluorocarbon chain formula of:

$$-(CH_2-CF_2)_x-(\overset{\overset{\displaystyle CF_3}{|}}{C}F-CF_2)_y-(CF_2-CF_2)_z(XBr)-$$

wherein x represents 35 mole %, y represents 34 mole %, z represents 29 mole %, X represents crosslink sites, and the percent of XBr is about 2 mole %.

12. The method according to claim 6, wherein said developer is a liquid developer that contains a charge director compound.

13. The method according to claim 12, wherein said charge director compound is selected from the group consisting of an oil-soluble petroleum sulfonate and an AB diblock copolymer.

14. The method according to claim 13, wherein said charge director compound is an AB diblock copolymer.

15. A method for reducing the charge exchange between a liquid developer and an intermediate transfer member, comprising using as the intermediate transfer member a member comprising a fluorocarbon elastomer containing less than 60 mole % vulnerable sites in the fluorocarbon chain.

16. The method according to claim 15, wherein said intermediate transfer member comprises a fluorocarbon elastomer having less than 50 mole % vulnerable sites in the fluorocarbon chain.

17. The method according to claim 15, wherein said intermediate transfer member comprises a fluorocarbon elastomer having less than 40 mole % vulnerable sites in the fluorocarbon chain.

18. The method according to claim 15, wherein said fluorocarbon elastomer is a terpolymer of vinylidene fluoride, hexafluoropropylene and tetrafluoroethylene.

19. The method according to claim 18, wherein said fluorocarbon elastomer has a fluorocarbon chain formula of:

$$-(CH_2-CF_2)_x-(\overset{\overset{\displaystyle CF_3}{|}}{C}F-CF_2)_y-(CF_2-CF_2)_z(XBr)-$$

wherein x represents 35 mole %, y represents 34 mole %, z represents 29 mole %, X represents crosslink sites, and the percent of XBr is about 2 mole %.

20. The method according to claim 15, wherein said liquid developer contains a charge director compound.

21. The method according to claim 15, wherein said charge director compound is selected from the group consisting of an oil-soluble petroleum sulfonate and an AB diblock copolymer.

22. The method according to claim 21, wherein said charge director compound is an AB diblock copolymer.

23. An electrostatographic printing system comprising an electrostatographic imaging member, at least one developing station for developing a toner image and an intermediate transfer member for transferring the toner image from the electrostatographic imaging member to an image receiving substrate, said intermediate transfer member comprising a fluorocarbon elastomer containing less than 60 mole % vulnerable sites in the fluorocarbon chain and said fluorocarbon elastomer being conformable.

* * * * *